US005360109A

United States Patent [19]

Janota

[11] Patent Number: 5,360,109

[45] Date of Patent: Nov. 1, 1994

[54] PACKAGING TRAY FOR ELECTRICAL CONNECTORS

[75] Inventor: Kenneth F. Janota, Lisle, Ill.

[73] Assignee: Molex Incorporated, Lisle, Ill.

[21] Appl. No.: 54,333

[22] Filed: Apr. 28, 1993

[51] Int. Cl.[5] ..... B65D 85/30

[52] U.S. Cl. ..... 206/328; 206/332; 206/564

[58] Field of Search ..... 206/328, 332, 334, 564, 206/331

[56] References Cited

U.S. PATENT DOCUMENTS

| | | | |
|---|---|---|---|
| 3,272,371 | 9/1966 | Weiner | 206/564 X |
| 3,589,511 | 6/1971 | Britt | 206/564 X |
| 4,171,049 | 10/1979 | Nohara et al. | 206/328 |
| 4,501,363 | 2/1985 | Isbey, Jr. | 206/564 X |
| 4,632,246 | 12/1986 | Brutosky . | |
| 4,653,665 | 3/1987 | Heisner et al. . | |
| 4,671,407 | 6/1987 | Brutosky | 206/332 |
| 4,770,591 | 9/1988 | Wright et al. . | |
| 4,856,455 | 8/1989 | Tee . | |
| 5,012,925 | 5/1991 | Gallagher, Sr. | 206/332 |

*Primary Examiner*—Bryon P. Gehman
*Attorney, Agent, or Firm*—A. A. Tirva

[57] ABSTRACT

A manually manipulatable tray is provided for supporting electrical connectors. The tray includes a thin sheet of formed plastic material having side walls, an open end, a closed end and a floor. The floor has a plurality of generally parallel, spaced-apart, upwardly extending rails generally parallel to the side walls and defining generally parallel channels therebetween. A pair of finger-gripping portions are formed on a respective pair of the rails spaced inwardly of the side walls a sufficient distance such that an individual can finger-grip the finger-gripping portions with the individual's hands substantially being within the side walls of the tray. The pair of finger-gripping portions are located on opposite sides of a mid-point located generally equidistant between the open and closed ends of the tray.

1 Claim, 3 Drawing Sheets

PACKAGING TRAY FOR ELECTRICAL CONNECTORS

FIELD OF THE INVENTION

This invention generally relates to the art of electrical connectors and, particularly, to a manually manipulatable packaging tray for supporting electrical connectors.

BACKGROUND OF THE INVENTION

The automation of feeding and terminating electrical connectors has been ever-increasing in the connector industry to reduce labor costs and to increase speed and reliability of manufacture. However, with a corresponding ever-increasing trend toward miniaturization, difficulties continue to be encountered in handling large numbers of individual electrical connector components. Automatization, itself, has increased the problems of shipping, storing and automatic handling of such components. Specifically, many electrical connectors are manufactured/assembled in stages. Components may be produced, shipped and stored in intermediate assembly stages, and then the components are oriented and fed to automatic or partly automatic terminating machines.

One arrangement for handling such connector components is to use an elongated, generally tubular, hollow cassette having a uniform cross-sectional shape throughout its length and from which connector components are fed, such as feeding to automated terminating equipment. The cross-sectional shape of the cassette corresponds to the connector profile, and the cassette holds a serial array of the components. Feeding apparatus are provided at the automated terminating equipment or other assembly machine for unloading the cassettes and advancing full cassettes for replacing empty cassettes.

Another arrangement for handling such connector components is described in U.S. Pat. No. 4,770,591 to Wright et al, dated Sep. 13, 1988 and assigned to the assignee of this invention. In that patent, a packaging tray includes a matrix array of open-ended component receiving channels formed therein, each channel containing a serial array of electrical connectors. A box-like container holds a stacked array of the open-ended trays containing the connectors. The box has an open end in a common plane with the open ends of the channels of the trays. The connectors are fed, one at a time, from individual channels in a tray, and a shuttle is indexed along a row of channels, one channel at a time, until the tray is emptied. Thereafter, an adjacent tray containing another row of channels is brought into alignment for unloading.

A problem with the arrangement described in the U.S. Pat. No. 4,770,591 patent, above, is the difficulty of manually manipulating the trays filled with connector components. The trays are flat and difficult to balance, and the trays conventionally are formed from thin plastic sheet material and, consequently, are somewhat flimsy. In addition, loading the trays in a stacked array, one on top of another, in the box-like container is difficult because the edges of the trays cannot be grasped within the confines of the box-like container. As a result, connector components often are disturbed or moved out of their proper stored positions, entire trays can be spilled and the connector components, in fact, can be damaged. The present invention is directed to further improvements in packaging trays of the character described above, particularly in providing means for facilitating easy manual manipulation of the trays.

SUMMARY OF THE INVENTION

An object, therefore, of the invention is to provide an improved manually manipulatable packaging tray of the character described for supporting electrical connectors.

In the exemplary embodiment of the invention, the tray includes a thin sheet of formed plastic material having side walls, an open end, a closed end and a floor. The floor has a plurality of parallel, spaced-apart upwardly extending rails generally parallel to the side walls and defining parallel channels therebetween.

The invention contemplates the provision of a pair of finger gripping portions formed on a respective pair of the rails spaced inwardly of the side walls a sufficient distance such that an individual can finger-grip the finger-gripping portions with the individual's hands substantially being within the side walls of the tray.

According to another aspect of the invention, the pair of finger-gripping portions are located on opposite sides of a mid-point located generally equidistant between the open and closed ends of the tray. As disclosed herein, the finger-gripping portions are provided by reduced cross-sectioned portions of the respective pair of rails.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
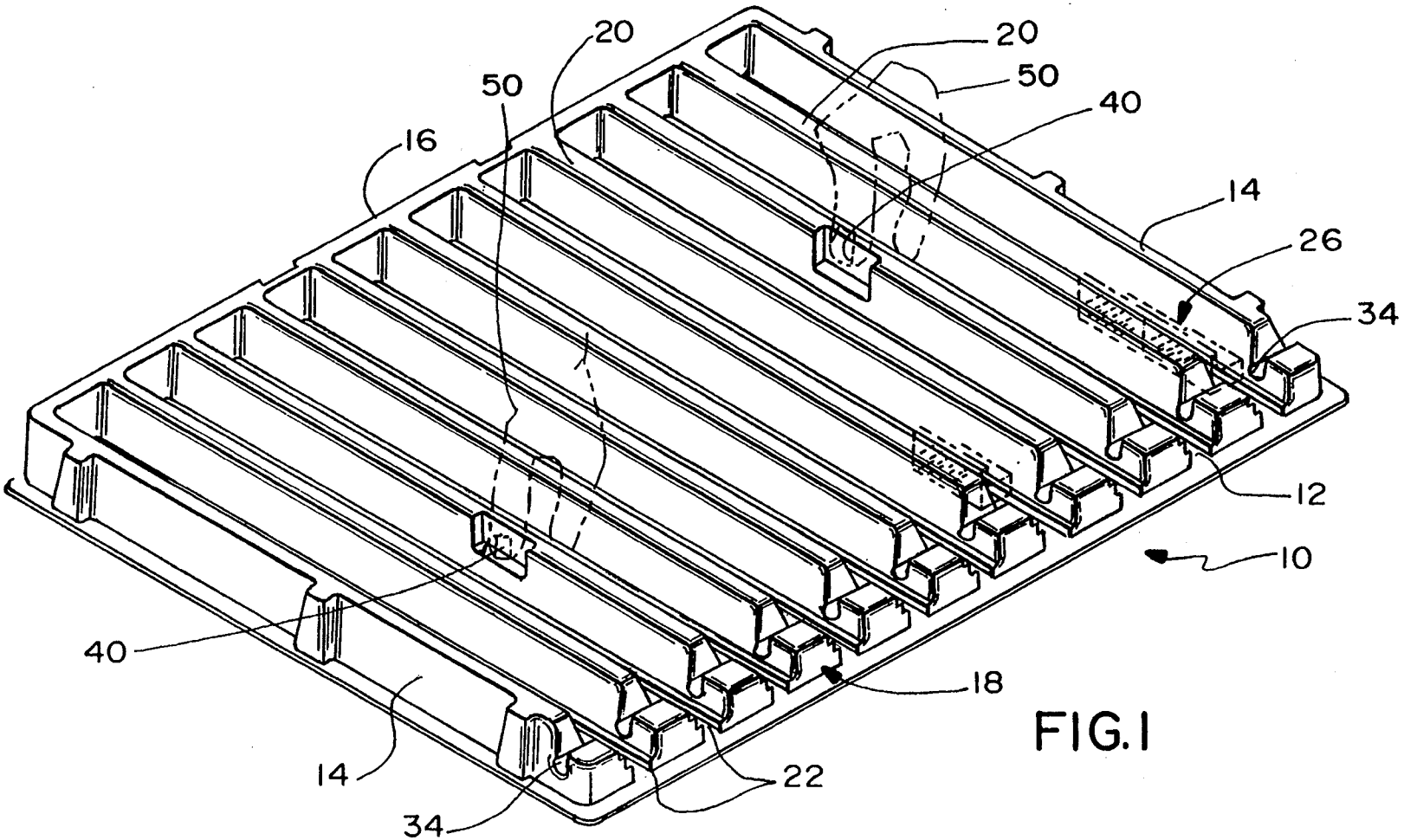
FIG. 1 is a perspective view of a packaging tray embodying the concepts of the invention.

Referring to the drawings in greater detail, the invention is incorporated in a packaging tray, generally designated 10, which includes a floor 12, opposite side walls 14, a closed end defined by a rear wall 16 and an open front end 18. A plurality of parallel, spaced-apart rails 20 extend upwardly from floor 12 and extend generally parallel to side walls 14. The rails define parallel channels 22 therebetween, and the channels are open at open end 18 of the tray.

Although the tray is shown not completely full in FIG. 1, a plurality of electrical connector components, generally designated 26, are loaded in serial arrays within channels 22 between rails 20. Each rail has at least one longitudinally extending shoulder 28 onto which a housing 30 of each connector 26 is positioned, with terminal pins 32 of the connector components projecting above the shoulders without touching the rail 20 or any other portion of the tray. Side walls 14 and each rail 20 are provided with notches 34 near the open end of the tray and the open ends of channels 22. An appropriate blocking means, such as a rod-like member, can be positioned in the notches to hold the connectors lengthwise within channels 22.

As stated in the "Background", above, packaging trays 10 are used to feed connectors 26 to automatic or partly automatic terminating machines or to other types of apparatus, by feeding the connectors serially from the open ends of channels 22 into the machine or apparatus. The trays, themselves, are stacked one on top of another in a box-like container. The entire container may be lowered into a machine, presenting one tray at a time to the machine, and also presenting one connector-receiving channel of an individual tray to the machine. The trays are vacuum formed from sheet plastic material and are generally "flimsy" in character, particularly when fully loaded with connector components. The trays are dimensioned to fit closely in the box-like container to prevent movement therewithin. During loading or unloading of the trays in the container, the edges of the trays cannot be grasped, and it is very difficult to lift the individual trays out of the container without disturbing the connectors or damaging the terminal pins or, in fact, actually spilling the connectors from the tray.

Figure 3:
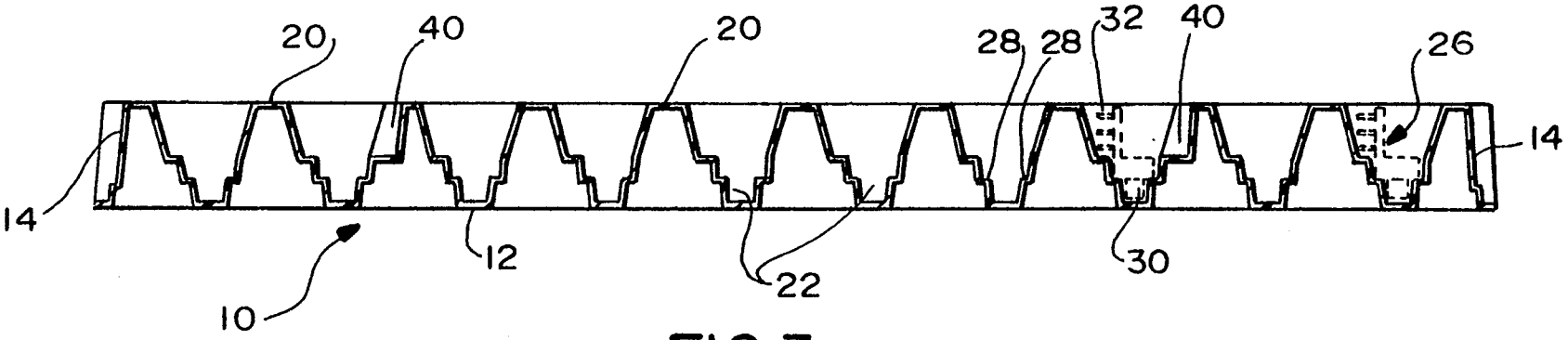
FIG. 3 is a section taken generally along line 3—3 of FIG. 2.

Consequently, the invention contemplates the provision of a pair of finger-gripping portions, generally designated 40, formed on a respective pair of rails 20. In essence, the finger-gripping portions are formed by reduced cross-section dimensional portions of the respective pair of rails during the vacuum forming process of the sheet plastic material. This is seen best in FIG. 3.

Figure 2:
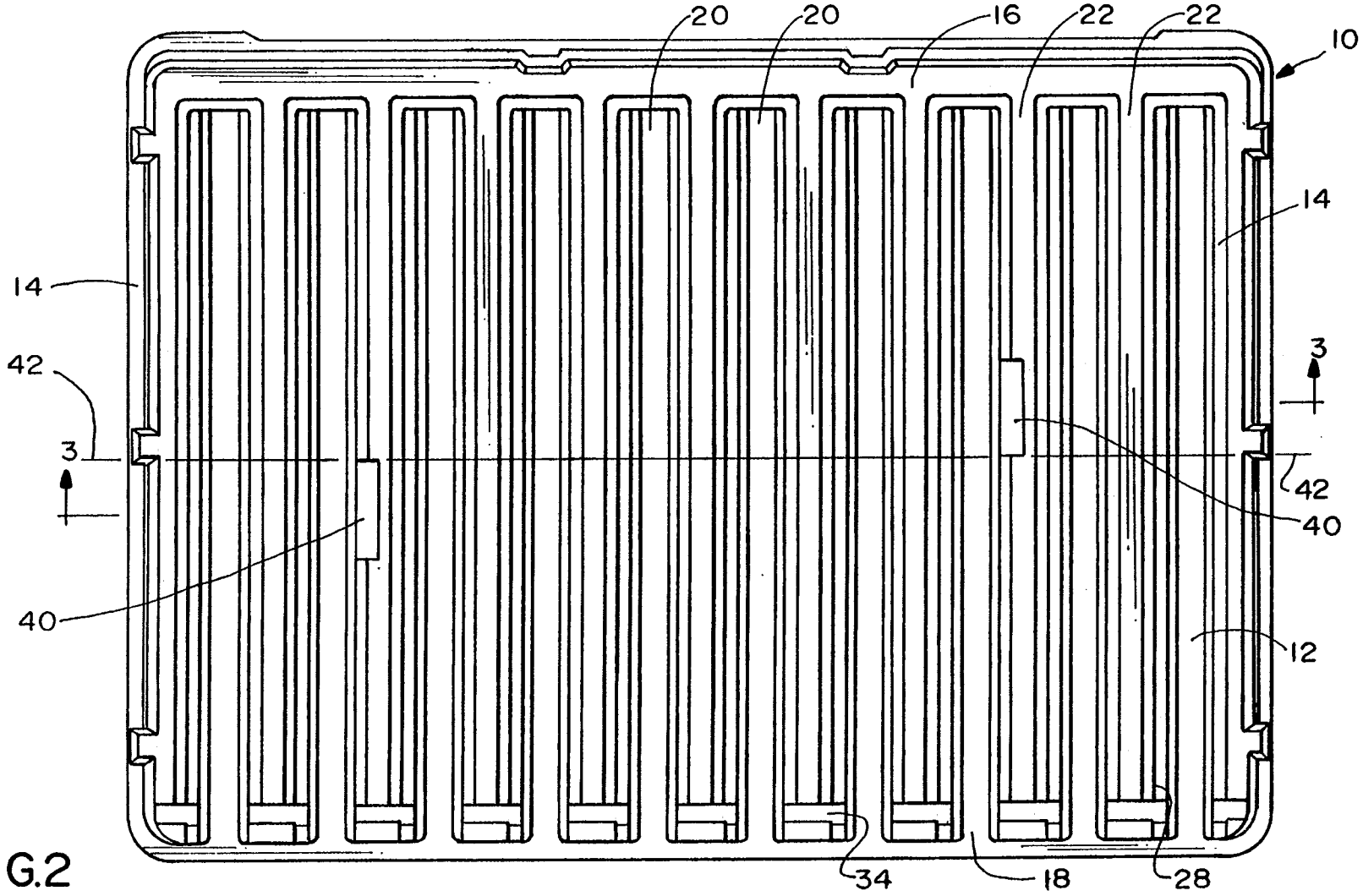
FIG. 2 is a top plan view of the tray.

FIGS. 1 and 2 show the locations of finger-gripping portions 40 according to the invention and for facilitating easy manual manipulation of the entire tray, particularly when the tray is loaded with electrical connectors 26. More particularly, finger-gripping portions 40 are shown to be spaced inwardly of side walls 14. This spacing should provide a sufficient distance between the finger-gripping portions and the side walls so that an individual can finger-grip portions 40 within the side walls of the tray. In this manner, the individuals's hands 50 will be within the bounds of the tray and clear of the inside walls of a box-like container within which the trays may be stacked. As seen in the drawings, finger-gripping portions 40 are formed in the second rail 20 spaced inwardly of each side wall 14. In actual practice, this distance may be on the order of at least approximately two and one half inches between each finger-gripping portion 40 and the side wall of the tray.

According to another aspect of the invention, the finger-gripping portions are offset in a front-to-rear direction to facilitate the user in balancing the tray during manual manipulation thereof. Specifically, as best seen in FIG. 2, a mid-point of the tray in a front-to-rear direction is indicated by phantom line 42. It can be seen that one of the finger-gripping portions is offset in front of the mid-point, and the other finger-gripping portion is offset to the rear of the mid-point. In essence, this disposition of the finger-gripping portions forces an individual to grip the tray in a balanced manner before the individual even begins to lift the tray off of a support surface or out of the box-like container.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a manually manipulatable tray for supporting electrical connectors, including a thin sheet of formed plastic material having generally parallel side walls, an open end, a closed end and a floor, the floor having a plurality of generally parallel, spaced-apart upwardly extending rails generally parallel to the side walls and defining generally parallel channels between adjacent rails and each side wall and its adjacent rail, wherein the improvement comprises a finger-gripping portion formed on each of a pair of said rails, each of said pair of rails spaced inwardly of the side walls a sufficient distance such that an individual can finger-grip the finger-gripping portions with the individual's hands substantially being within the side walls of the tray, wherein said pair of finger-gripping portions are located on opposite sides of a mid-point line located generally equidistant between said open and closed ends, and each of said finger-gripping portions comprise a reduced cross-section portion of one of said pair of rails and said reduced cross-section portions extending in opposite directions from said mid-point line.

* * * * *